US005118909A

United States Patent [19]

Husting

[11] Patent Number: 5,118,909

[45] Date of Patent: Jun. 2, 1992

[54] SWITCH ACTUATOR

[75] Inventor: Thomas J. Husting, Sheboygan Falls, Wis.

[73] Assignee: Kohler Co., Kohler, Wis.

[21] Appl. No.: 606,363

[22] Filed: Oct. 31, 1990

[51] Int. Cl.[5] ..... H01H 37/38

[52] U.S. Cl. ..... 200/81 H; 200/81 R; 200/302.2

[58] Field of Search ..... 200/61.6, 81 H, 81 R, 200/302.2, 341, 342, 245

[56] References Cited

U.S. PATENT DOCUMENTS

| | | | |
|---|---|---|---|
| 3,904,842 | 1/1974 | Gaver | 200/81 R |
| 4,124,789 | 11/1978 | Preece | 200/81 R |
| 4,209,678 | 6/1980 | Hussey | 200/81 R |
| 4,577,353 | 3/1986 | Veigener | 4/544 |
| 4,586,204 | 5/1986 | Daniels | 4/542 |
| 4,681,994 | 7,1987 | Nagata et al. | 200/16 B |
| 4,754,107 | 6/1988 | Tracey | 200/83 P |
| 4,861,231 | 8/1989 | Howard | 417/38 |

*Primary Examiner*—Howard L. Williams
*Assistant Examiner*—D. Le
*Attorney, Agent, or Firm*—Quarles & Brady

[57] ABSTRACT

A switch actuator for use with an electrical switch sensitive to changes in air pressure includes a bellows formed of a flexible material. The bellows is attached to a nipple having a passageway for operatively connecting the actuator to the electrical switch. A sleeve is shrink fitted over the outer surface of the nipple, causing the bellows to be lodged between the sleeve and the nipple. The sleeve includes a tubular sidewall with an inwardly-extending flange defining a central opening. A button is slidable relative to the sleeve and includes a projection extending through the central opening to engage the bellows. Pressing the button deforms the bellows, thereby decreasing the volume of a cavity formed between the bellows and the nipple.

18 Claims, 2 Drawing Sheets

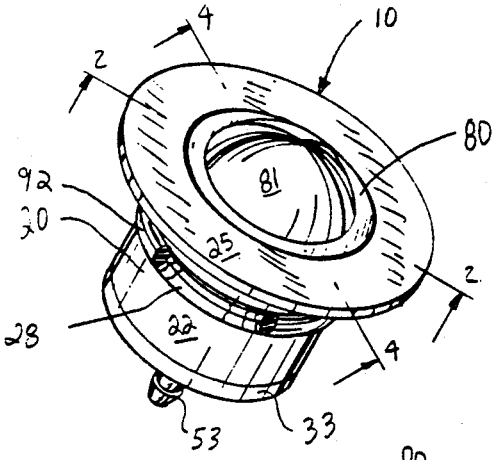
FIG. 1
FIG. 2
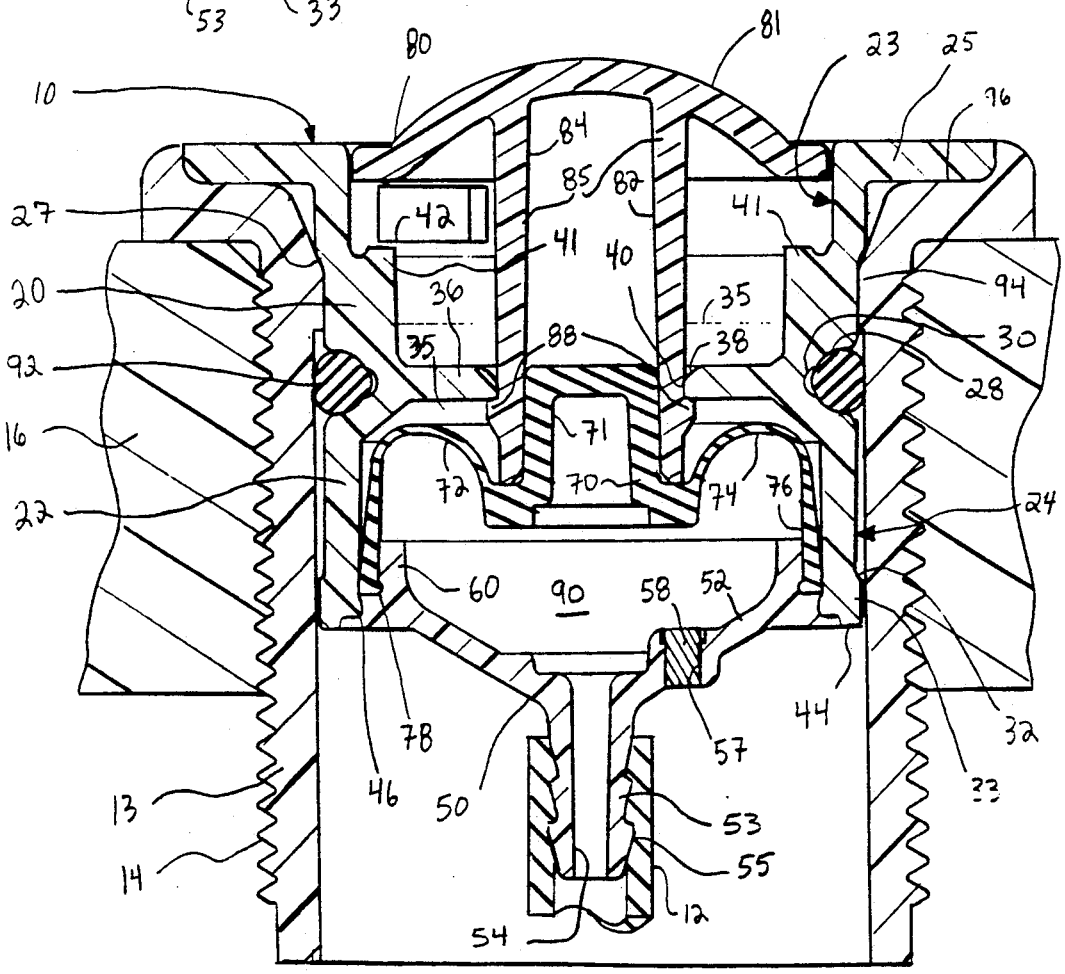
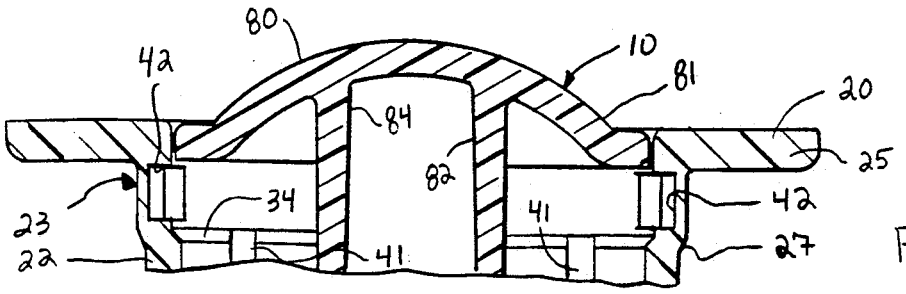
FIG. 4

FIG. 3
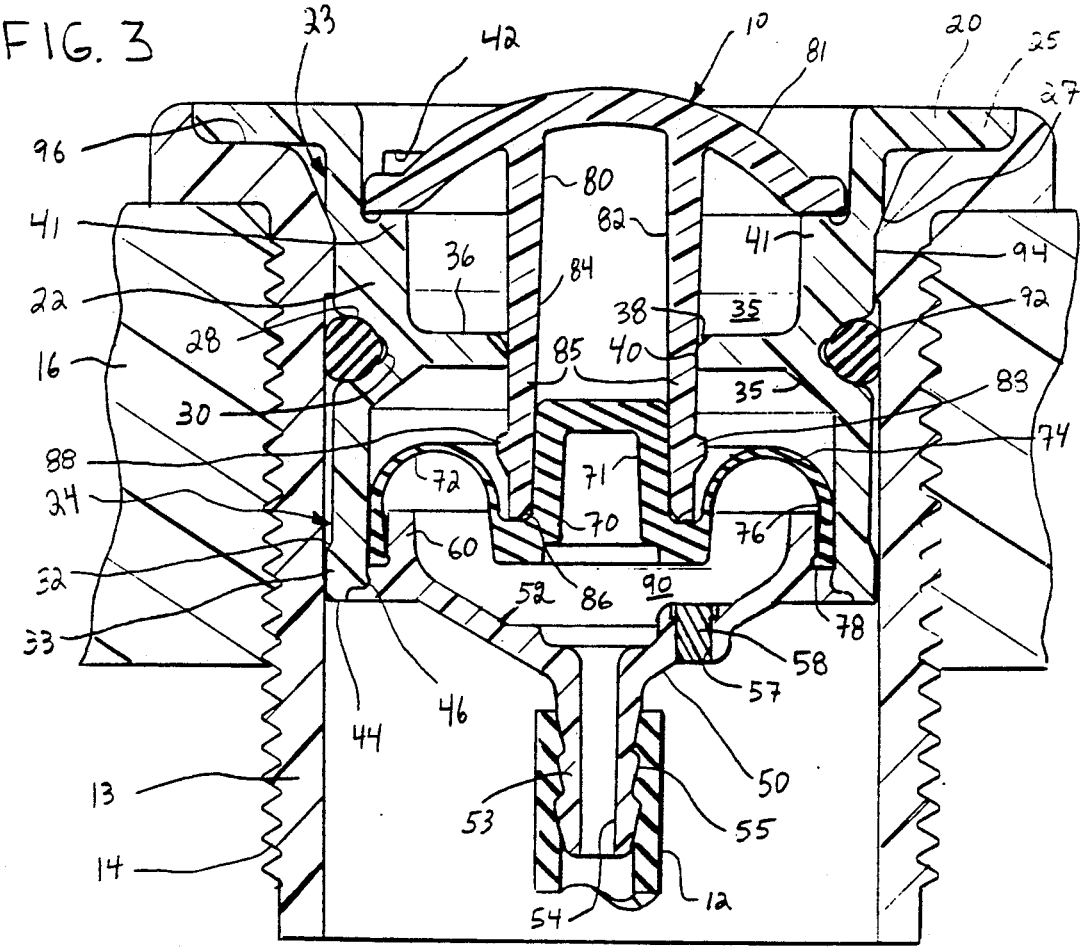
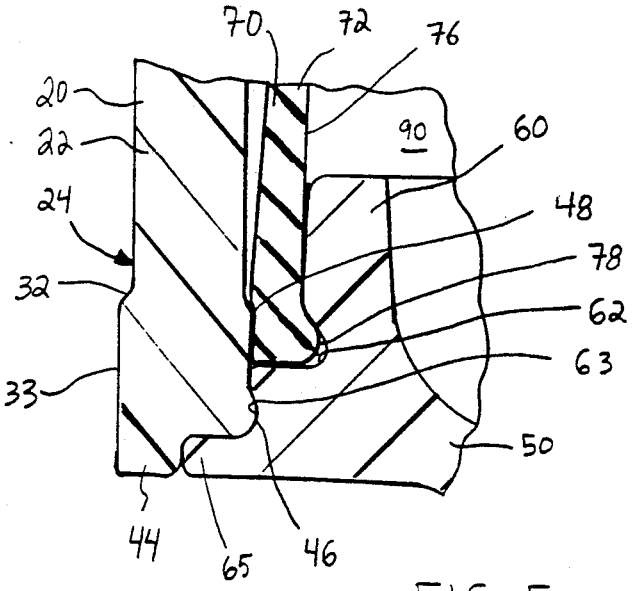
FIG. 5
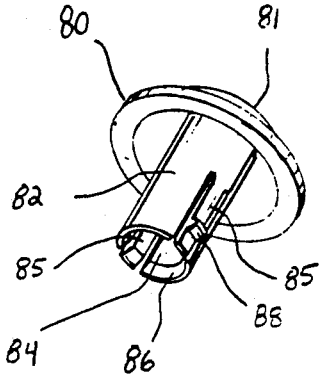
FIG. 6

SWITCH ACTUATOR

BACKGROUND OF THE INVENTION

The present invention relates to an actuator for controlling the status of an electrical switch. More particularly, it pertains to an actuator designed to produce a change in (air pressure) which is transmitted to a remotely-located electrical switch that is sensitive to the change in air pressure, thereby altering the status of the switch.

To minimize the potential for electrical shocks, it is frequently desirable for an electrical switch to be located remote from the switch actuator, and for the actuator not to incorporate an electrical current for controlling the switch. This is especially true where the user is situated in a water environment, such as a bathtub or a whirlpool. In these environments, the user may want to control electrical lighting, a water heater, or a water pump. For convenience reasons, the switch actuators for these devices should be within reach of the user, and for the safety reasons, all electrical currents should be located distant from the user and the actuators.

Consequently, both switch actuators that produce a change in air pressure and electrical switches that respond to the change in air pressure have been developed. In U.S. Pat. No. 4,754,107, for example, master and slave units having variable volume chambers are in air communication with each other. Movement of a flexible bellows in the master chamber increases the air pressure in both the master and slave units. The increased pressure in the slave chamber activates an electrical switch.

In switch actuators of this type, the flexible bellows is not isolated from the person controlling the switch. Therefore, the user may press on the bellows from a variety of directions. The force applied to the bellows may be at an angle that is ineffective to operate the switch. Alternatively, the force may be in a direction that causes excessive wear of the bellows. Forces in undesirable directions may also result in accidental disassembly of the actuator. Furthermore, when the actuator is used in a public environment, an unprotected flexible bellows may be subject to vandalism.

It can therefore be seen that a need exists for an improved switch actuator incorporating a flexible bellows, where the actuator isolates and protects the bellows from the user and produces effective switch control on a repetitive basis.

SUMMARY OF THE INVENTION

The present invention is an improved switch actuator which is designed for use with an electrical switch that is sensitive to changes in air pressure. The switch actuator includes a sleeve with a tubular sidewall that has an upper end and an opposite lower end. Between the upper and lower ends, the sleeve has a flange extending inwardly from the sidewall to define a central opening. A nipple having a passageway is attached to the sleeve adjacent the lower end of the sidewall. A bellows formed of a flexible material has a central crown and a skirt surrounding the central crown. The periphery of the skirt is positioned against the nipple to form a cavity between the bellows and the nipple. The actuator also has a button that is slidably mounted relative to the sleeve. The button has a contact surface and a projection extending from the contact surface. The projection extends through the central opening and contacts the bellows. Movement of the button relative to the sleeve deforms the bellows and changes the volume of the cavity.

A general object of the invention is to provide a switch actuator that functions effectively during repeated operations over the lifetime of the switch. By slidably mounting the button within the sleeve and having the projection of the button extend through the central opening and contact the bellows, the bellows deforms in the preferred manner for each actuation to consistently generate the pressure increase which will activate the switch. The bellows thus is not subject to forces in undesirable directions that may excessively wear the bellows or ineffectively change the status of the switch.

Another object of the invention is to provide a switch actuator incorporating a flexible bellows where the actuator isolates the bellows from the user. By positioning the bellows against the nipple, attaching the nipple to the sleeve, and using the button to extend through the central opening and contact the bellows, the bellows is out of direct contact with the user. The button and sleeve, which the user may contact, can be formed of a more durable material than is used for the bellows. The flexible bellows is protected from undesirable contact and vandalism. Additionally, the actuator forms a unit which may be installed or removed without separating the individual components, and which is generally free from accidental disassembly.

These and other objects and advantages of the invention will appear from the following description. In the description, references made to the accompanying drawings which form a part hereof, and in which there is shown a preferred embodiment of the invention. Such embodiment does not represent the full scope of the invention, and reference is therefore made to the claims herein for interpreting the scope of the invention.

BRIEF DESCRIPTION OF THE DRAWINGS

FIG. 1 is a view in perspective of a switch actuator according to the present invention;

FIG. 2 is a view in vertical section of the switch actuator taken from the plane of the line 2—2 in FIG. 1, and showing the switch actuator mounted within a mounting cylinder and a whirlpool housing;

FIG. 3 is a view in vertical section similar to FIG. 2, but showing the switch actuator in an activated state;

FIG. 4 is a view in vertical section of the switch actuator taken in the plane of the line 4—4 in FIG. 1;

FIG. 5 is an enlarged view in section showing the attachment of several components of the switch actuator; and FIG. 6 is a view in perspective of a button component of the switch actuator.

DETAILED DESCRIPTION OF THE PREFERRED EMBODIMENT

With reference to FIGS. 1 and 2, a switch actuator 10 of the present invention is designed to be connected by tubing 12 to a remotely-located electrical switch (not shown). The switch actuator 10 creates an increased air pressure which is transmitted through the tubing 12 to a movable diaphragm of the switch. In response to the change in air pressure, the diaphragm changes the operative condition of the switch. As described in greater detail below, the actuator 10 is secured by a friction fit to a mounting cylinder 13. The mounting cylinder 13 includes external threads 14 designed to engage mating threads formed in a whirlpool housing 16. Although the switch actuator 10 is described for use in combination with the electrical devices in a bathing environment, the actuator 10 may be useful in any application where a non-electronic, remotely-located actuator 10 is desired.

The switch actuator 10 includes a sleeve 20 having a tubular sidewall 22. The tubular sidewall 22 has an upper end 23 and an opposite lower end 24. An annular-shaped rim 25 of the sleeve 20 extends radially outward from the upper end 23. Below the rim 25, the exterior of the sidewall 22 tapers inward at 27. Between the upper and lower ends 23 and 24, the tubular sidewall 22 is formed with a groove 28 circumscribing the sleeve 20. A rounded channel 30 is formed within the groove 28. The lower end 24 of the tubular sidewall 22 tapers outward at 32 forming a base portion 33 with an expanded thickness.

The inner surface of the tubular sidewall 22 tapers inward at 34 (FIG. 4), corresponding to the taper on the outer surface of the sidewall at 27. Intermediate the upper and lower ends 23 and 24, the inner surface of the sidewall 22 includes angled walls 35 (FIGS. 2 and 3) which form the base of an inwardly-extending flange 36. The upper surface of the flange 36 tapers inward at 38 to define a central opening 40 of the sleeve 20. The groove 28 and channel 30 do not impair the strength of the sleeve 20 because they are formed at the axial position on the sleeve 20 that corresponds to the position of the angled walls 35. Four stop surfaces in the form of columns 41 are spaced equidistantly about the inner surface of the tubular sidewall 22. The columns 41 extend upward from the angled wall 35 (FIGS. 2 and 3) located above the inwardly-extending flange 36. The inner surface of the sidewall 22 also includes a pair of recesses 42 (FIGS. 2–4) positioned slightly beneath the rim 25. The recesses 42 are preferably located opposite one another and do not extend completely through the sidewall 22.

With particular reference to FIG. 5, the base portion 33 of the tubular sidewall 22 includes a lower edge 44 and a contoured interior surface which defines a rib 46 and a rise 48. The rib 46 and rise 48 engage other components of the switch actuator 10, as more fully described below.

The switch actuator 10 also includes a funnel-shaped nipple 50 that engages the base portion 33 of the sleeve 20. The nipple 50 includes a conical main surface 51 surrounding a tubular extension 53 that contains a passageway 54. The exterior of the tubular extension 53 is formed with a barbed surface 55 to retain the tubing 12 for operatively connecting the switch actuator 10 to the pressure-sensitive electrical switch. A bleed hole 57 is formed in the main surface 51 of the nipple 50. A restrictor 58, preferably formed of a slightly-porous material such as sintered stainless steel, may be friction fit or otherwise suitably lodged within the bleed hole 57.

Extending away from the tubular extension 53, the main surface 51 curves inward to form a longitudinally-extending wall 60. As shown most clearly in FIG. 5, outward of the wall 60, the periphery of the nipple 50 includes a contoured outer surface defining an upper pocket 62, a lower pocket 63, and a radially-extending ring 65.

A bellows 70 of the switch actuator 10 is formed of a thermoplastic polyester elastomer. The bellows 70 functions as an air-moving diaphragm and is a capable of being distorted and resiliently returning to its original shape. The preferred material for the bellows 70 is model G-4074 thermoplastic polyester elastomer, sold under the trademark HYTREL by Du Pont Company. The preferred material has a durometer hardness of approximately 40D and a flexural modulus of approximately 65 MPa.

The bellows 70 is formed with a central crown 71 which is surrounded by a skirt 72. The skirt 72 includes a curved portion 74 adjacent the central crown 71 and an axially-extending tapered wall 76. The skirt 72 terminates in an inwardly-directed foot 78. The bellows 70 is molded or otherwise formed so that the central crown 71 is relatively thick and inflexible compared to the skirt 72. The curved portion 74 is the thinnest part of the skirt 72, and the thickness gradually increases along tapered wall 76 toward the foot 78.

The switch actuator 10 also includes a button 80 having a contact surface 81 and a projection 82 extending away from the contact surface. The contact surface 81 is in the form of a hemispherical dome, the exterior of which may be grooved or otherwise contoured (not shown). Referring to FIG. 6, the projection 82 includes a central bore 84 and two oppositely positioned beams 85. The beams 85 are somewhat resilient because the button 80 is preferably formed of a plastic material. A leading edge 86 of the projection 82 is tapered inward, and each beam 85 includes an outwardly-extending ridge 88. As best shown in FIG. 3, the lower edges of the ridges 88 are more gradually tapered than the upper edges.

The components of the switch actuator 10 are assembled in the following manner. The flexible bellows 70 is first snap fitted to the nipple 50 as illustrated in FIGS. 2 and 5. The tapered wall 76 of the bellows 70 is pressed over the wall 60 of the nipple 50 until the foot 78 lodges within the upper pocket 62. The size of the bellows 70 and foot 78 are such that the bellows is retained on the nipple 50. At this point, however, the bellows 70 may be removed from the nipple 50 due to the flexible nature of the material forming the bellows 70. A cavity 90 is formed between the nipple 50 and the bellows 70.

The sleeve 20 is preferable formed of a plastic material in an injection molding process. As previously noted, the interior surface of the base portion 33 is formed with an inwardly-extending rib 46 adjacent a lower edge 44 and an inwardly-projecting rise 48 above of the rib 46. The interior diameter of the sleeve 20 at the position of the rise 48 is equal to or slightly less then the outside diameter of the bellows 70 at the foot 78. Similarly, the interior diameter of the sleeve 20 at the position of the rib 46 is equal to or slightly less then the outside diameter of the nipple 50 in the lower pocket 63.

The sleeve 20 is secured to the nipple 50 by positioning the nipple, with the bellows 70 attached, inside the base portion 33 of the tubular sidewall 22 when the sleeve 20 exits the injection molding process. As the material of the sleeve 20 cools, the base portion 33 shrinks, thereby impinging on the nipple 50 and the bellows 70. The expanded thickness of the base portion 33 causes the base portion to shrink slightly more than the portion of the sidewall 22 immediately above the base portion. As the sleeve 20 cools, the rib 46 lodges within the lower pocket 63 of the nipple 50, and the foot 78 is pinched between the rise 48 and the wall 60 of the nipple 50. The ring 65 fits inside the lower edge 44 of the tubular sidewall 22. When the material of the sleeve 20 cools, the interengagement of the contoured surfaces of the interior of the base portion 33 and the exterior of the nipple 50 prevents the sleeve 20 and nipple 50 from being easily disassembled.

Assembly of the switch actuator 10 is completed by slidably mounting the button 80 within the sleeve 20. The hemispherical dome 81 is sized to fit within the upper end 23 of the sleeve 20. The diameter of the projection 82 allows the projection to fit inside the central opening 40, although the ridges 88 on the beams 85 contact the flange 36 and cause the beams 85 to bow inward as the ridges 88 pass through the central opening 40.

When the button 80 is inserted into the sleeve 20, the tapered edges 86 of the projection 82 encounter the central crown 71 of the bellows 70. The tapered edges 86 cause the central crown 71 to begin to insert into the central bore 84 of the projection 82. As the button 80 is inserted further, the ridges 88 contact the flange 36. Inward movement of the beams 85 is resisted by contact with the central crown 71, because the crown portion is only slightly smaller than the central bore 84. Nevertheless, the beams 85 can bow inward because the central crown 71 has not yet been inserted into the central bore 84 to a position inward of the ridges 88. Thus, slight downward pressure on the dome 81 causes the ridges 88 to pass inside the central opening 40. Downward movement of the ridges 88 through the central opening 40 is aided by the tapered upper surface 38 of the flange 36 and the tapered lower surfaces of the ridges 88. After the ridges 88 pass through the central opening 40, the beams 85 flex outwardly to the position shown in FIG. 2, enabling the central crown 71 to insert fully into the central bore 84 of the projection 82.

As a result of this configuration, the button 80 is locked within the sleeve 20. Upward movement of the button 80 above the position shown in FIG. 2 is resisted by contact between the ridges 88 and the inwardly-extending flange 36. The upper surfaces of the ridges 88 and the lower surface of the flange 36 are not gradually tapered, thus the ridges 88 do not easily slide inside the flange 36 when the button 80 moves upward. Moreover, inward movement of the beams 85 is now fully hindered by contact with the central crown 71 which is completely inserted into the central bore 84. The projection 82 is sized such that the ridges 88 are positioned adjacent the lower edge of the flange 36 when the periphery of the hemispherical dome 81 is adjacent the rim 25. Thus, there is no exposed surface of the button 80 which can be used to pry the button upward.

The assembled switch actuator 10 may then be mounted and operatively connected to the electrical switch. The tubing 12 is attached to the barbed surface 55 of the tubular extension 53. The actuator 10 is then secured to the mounting cylinder 13 using an O-ring 92. The O-ring 92 is positioned in the groove 28, and the actuator 10 is pressed into the mounting cylinder 13. In order to pass an inwardly-extending lip 94 of the mounting cylinder 13, the O-ring 92 may compress partially into the channel 30. Once the O-ring 92 passes beneath the lip 94, it expands to a rest position within the groove 28 and presses against the inside wall of the mounting cylinder 13. The actuator 10 is inserted into the mounting cylinder 13 until the rim 25 of the sleeve 20 resides in a recessed top portion 96 of the mounting cylinder 13, and the taper portion 27 of the sidewall 22 contacts the lip 94.

The purpose of the O-ring 92 is to frictionally retain the actuator 10 within the mounting cylinder 13. The O-ring 92 could also be used to form a water seal between the sleeve 20 and the mounting cylinder 13. Note that the whirlpool housing 16 could be shaped to frictionally receive the actuator 10 directly, rather than using the mounting cylinder 13 as shown.

When the electrical switch is to be activated, the user presses downward on the button 80. The button 80 can slide within the sleeve 20 until the periphery of the dome 81 encounters the columns 41 of the sidewall 22. As the button 80 is depressed, the projection 82 forces the central crown 71 of the bellows 70 toward the tubular extension 53, thereby decreasing the volume of the cavity 90. As a result, the air pressure increases in the cavity 90, the tubing 12, and a corresponding chamber of the switch. The increased pressure in the switch chamber activates the switch.

The bellows 70 is capable of acting as a diaphragm due to its shape and the resilient nature of the material. As shown by FIG. 3, the button 80 deforms the bellows 70 in the relatively thin curved portion 74 and the tapered wall 76 of the skirt 72. Upon releasing the button 80, the resiliency of the bellows 70 is sufficient to slide the button 80 upward until the bellows 70 returns to its original shape (see FIG. 2). Thus, the button 80 returns to its ready position without requiring springs or other mechanical devices. Because the bellows 70 flexes in the same manner every time the button 80 is pressed, the bellows 70 does not wear as a result of improper contact. Further, the button 80 is not pressed in directions that would damage the seal between the nipple 50 and the bellows 70.

The restrictor 58 in the bleed hole 57 does not interrupt operation of the actuator 10 because the restrictor material is sufficiently dense so that it does not rapidly release air from the cavity 90 when the button 80 is pressed. If the button 80 were continually depressed, however, the higher pressure air in the cavity 90 would slowly (on the order of several seconds) escape through the restrictor 58 to the atmosphere. One face of a diaphragm in the electrical switch is exposed to the atmosphere. The restrictor 58 prevents the switch from being accidently actuated as a result of rapid atmospheric pressure drops by allowing the pressure in the cavity 90 to slowly (within several seconds) track the atmospheric pressure.

The components of the switch actuator 10 are structured to lock together once the actuator 10 is assembled. This feature simplifies installation of the actuator 10, protects the flexible bellows 70, and deters vandalism.

Another feature which deters vandalism is that the means of removing the actuator 10 from the mounting cylinder 13 is not entirely obvious. As suggested in FIG. 3, however, the recesses 42 on the interior surface of the tubular sidewall 22 may be accessed when the button 80 is fully depressed. A screwdriver or other tool may be inserted into the recesses 42 to lift the sleeve 20 out of the mounting cylinder 13. It may be desirable to remove the actuator 10 from the mounting cylinder 13, for example, to check the connection between the tubing 12 and the nipple 50.

It should be apparent to those skilled in the art that many variations are possible from the preferred embodiment of the invention described herein. For example, the interior surface of the tubular sidewall 22 could be formed with a ledge to limit downward movement of the button 80, rather than using the columns 41 as shown. Similarly, the sleeve 20 could be attached to the housing 16 using adhesive, screws or other suitable fasteners. Therefore, the invention should not be limited by the specific embodiment described, but only by the claims.

I claim:

1. A switch actuator, comprising:

a sleeve having a tubular sidewall;

a nipple attached to the sleeve, the nipple having a passageway;

a bellows formed of a flexible material, the bellows having a central portion and a skirt surrounding the central portion, the periphery of the skirt positioned against the nipple to form a cavity between the bellows and the nipple; and a button contacting the bellows and being slidably mounted relative to the sleeve, movement of the button relative to the sleeve deforming the bellows and changing the volume of the cavity.

2. The switch actuator of claim 1, wherein:

the tubular sidewall has an upper end and an opposite lower end; and the periphery of the skirt is pressed between the nipple and the lower end.

3. The switch actuator of claim 1, wherein:

the tubular sidewall has an upper end and an opposite lower end, the lower end having an inwardly-extending rib;

the periphery of the nipple is formed with a first pocket; and the rib extends into the first pocket.

4. The switch actuator of claim 3, wherein:

the periphery of the nipple is formed with a second pocket adjacent the first pocket; and the periphery of the skirt includes an inwardly-extending foot, the periphery of the skirt being pressed between the nipple and the lower end of the tubular sidewall with the foot extending into the second pocket.

5. The switch actuator of claim 3, wherein:

the inside diameter of the rib is the not greater than the outside diameter of the first pocket; and the rib is positioned in the first pocket by a shrink fit.

6. The switch actuator of claim 1, wherein:

the nipple has a main surface surrounding the passageway and a wall surrounding the main surface, the exterior of the wall defining a first pocket; and the tubular sidewall has an upper end, an opposite lower end, and a base portion adjacent the lower end, the base portion having an inwardly-extending rib, the rib positioned in the first pocket.

7. The switch actuator of claim 6, wherein:

the exterior of the wall defines a second pocket; and the skirt includes an inwardly-extending foot that resides in the second pocket.

8. The switch actuator of claim 7, wherein the base portion has an inwardly-extending rise located above the rib, the rise pressing the skirt against the nipple.

9. A switch actuator, comprising:

a sleeve having:

a tubular sidewall with an upper end and an opposite lower end; and a flange between the upper and lower ends extending inwardly from the sidewall, the flange defining a central opening;

a nipple attached to the sleeve adjacent the lower end of the sidewall, the nipple having a passageway;

a bellows formed of a flexible material, the bellows having a central crown and a skirt surrounding the central crown, the skirt positioned against the nipple to form a cavity between the bellows and the nipple; and a button having a contact surface and a projection extending from the contact surface, the button being slidable relative to the sleeve with the projection extending through the central opening and contacting the bellows, movement of the button relative to the sleeve deforming of the bellows and changing the volume of the cavity.

10. The switch actuator of claim 9, wherein:

the projection includes a central bore; and the central crown of the bellows is positioned in the central bore.

11. The switch actuator of claim 10, wherein:

the projection has at least one beam with an outwardly-extending ridge; and contact between the beam and the central crown limits inward movement of the beam toward the central bore.

12. The switch actuator of claim 11, wherein the ridges contact the flange and inhibit removal of the projection from within the central opening.

13. The switch actuator of claim 9, wherein stop surfaces between the flange and the upper end of the tubular sidewall limit movement of the contact surface relative to the sleeve.

14. A switch actuator, comprising:

a sleeve having:

a tubular sidewall with an upper end and an opposite lower end; and a flange between the upper and lower ends extending inwardly from the sidewall, the flange defining a central opening;

a nipple having a passageway, a main surface surrounding the passageway, and a wall outward of the main surface, the nipple being attached to the sleeve adjacent the lower end of the sidewall;

a bellows formed of a flexible material, the bellows having a central crown and a skirt surrounding the central crown, the periphery of the skirt positioned against the wall of the nipple to form a cavity between the bellows and the nipple; and a button having a contact surface and a projection extending from the contact surface, the button being slidable relative to the sleeve with the projection extending through the central opening and contacting the bellows, movement of the button relative to the sleeve deforming the bellows and changing the volume of the cavity.

15. The switch actuator of claim 14, wherein the tubular sidewall includes an exterior groove for receiving an O-ring, the groove being located in axial alignment with the inwardly-extending flange.

16. The switch actuator of claim 15, wherein a channel is formed within the groove.

17. The switch actuator of claim 14, wherein:

the nipple includes a bleed hole; and a slightly-porous restrictor is positioned in the bleed hole.

18. The switch actuator of claim 14, wherein the tubular sidewall has a base portion adjacent the lower end, the base portion having an enlarged thickness.

* * * * *